US007857671B2

(12) United States Patent
Carboni et al.

(10) Patent No.: US 7,857,671 B2
(45) Date of Patent: Dec. 28, 2010

(54) CONTACT FOR ELECTRICAL AND ELECTRONIC CONNECTIONS

(75) Inventors: Vittorio Carboni, Genoa (IT); Paolo Manzi, Genoa (IT)

(73) Assignee: Hypertac S.p.A., Genoa (IT)

( * ) Notice: Subject to any disclaimer, the term of this patent is extended or adjusted under 35 U.S.C. 154(b) by 24 days.

(21) Appl. No.: 12/299,568

(22) PCT Filed: Apr. 30, 2007

(86) PCT No.: PCT/EP2007/054212

§ 371 (c)(1),
(2), (4) Date: Nov. 4, 2008

(87) PCT Pub. No.: WO2007/128729

PCT Pub. Date: Nov. 15, 2007

(65) Prior Publication Data

US 2009/0203268 A1 Aug. 13, 2009

(30) Foreign Application Priority Data

May 5, 2006 (IT) ..... GE2006A0052

(51) Int. Cl.
*H01R 13/24* (2006.01)

(52) U.S. Cl. ..... 439/824; 324/754

(58) Field of Classification Search ..... 439/66, 439/578, 675, 700, 824, 842, 843, 851; 324/754, 324/755

See application file for complete search history.

(56) References Cited

U.S. PATENT DOCUMENTS

| | | | | |
|---|---|---|---|---|
| 2,237,362 A | | 4/1941 | Rieman | |
| 4,397,519 A | | 8/1983 | Cooney | |
| 4,504,780 A | * | 3/1985 | Marsella | 324/72.5 |
| 4,885,533 A | * | 12/1989 | Coe | 324/754 |
| 5,009,613 A | * | 4/1991 | Langgard et al. | 439/482 |
| 5,529,522 A | * | 6/1996 | Huang | 439/460 |
| 6,102,746 A | | 8/2000 | Nania et al. | |
| 6,159,056 A | * | 12/2000 | Boyle | 439/700 |
| 6,213,787 B1 | * | 4/2001 | Murphy | 439/71 |
| 6,517,379 B2 | * | 2/2003 | Leve | 439/578 |
| 6,848,922 B2 | * | 2/2005 | Coughlan et al. | 439/181 |
| 6,861,862 B1 | * | 3/2005 | Tate | 324/761 |
| 2009/0137158 A1 | * | 5/2009 | Carboni et al. | 439/660 |

FOREIGN PATENT DOCUMENTS

| | | |
|---|---|---|
| DE | 203 15 894 | 12/2003 |
| WO | WO 2006/005614 | 1/2006 |
| WO | WO 2006/025510 | 3/2006 |

* cited by examiner

*Primary Examiner*—Thanh-Tam T Le
(74) *Attorney, Agent, or Firm*—Stites & Harbison PLLC; Marvin Petry

(57) ABSTRACT

Contact for electrical or electronic connections, comprising a contact pin (1, 101) provided with resilient-tensioning means (4) which act in an axial direction on the said pin (1, 101), the said pin being provided with a coaxial stem (201) which extends at the end of said pin (1) opposite to that intended for connection, said stem (201) being inserted inside a contact means (3) in the form of a scored hyperboloid; said pin, being characterized in that said resilient-tensioning means (4) and said scored hyperboloid (3) are enclosed inside a substantially cylindrical and substantially single-piece container body (2; 5), locating means (202; 205) being envisaged for said resilient-tensioning means (4).

7 Claims, 2 Drawing Sheets

CONTACT FOR ELECTRICAL AND ELECTRONIC CONNECTIONS

Figure 1:
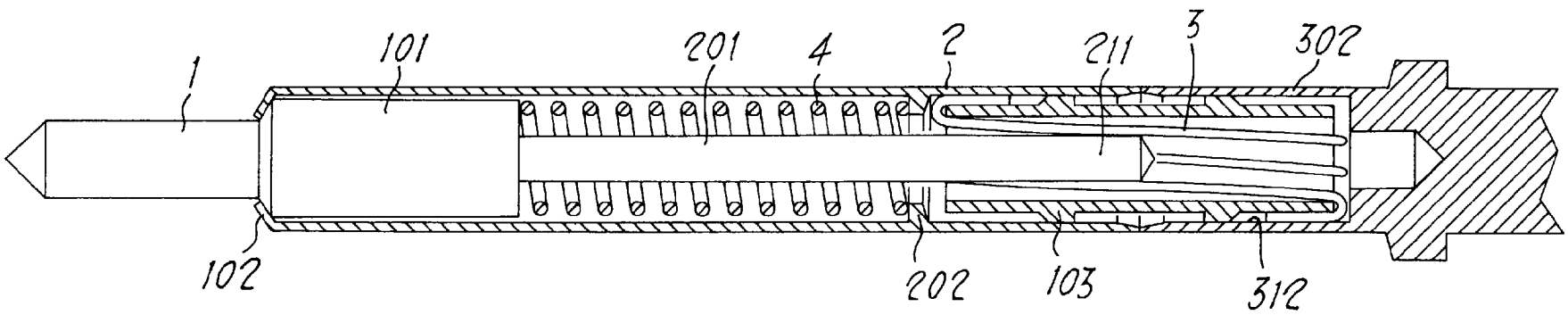

The present invention relates to a contact for electrical or electronic connections, and in particular relates to contacts where the contact pin is provided with resilient-tensioning means.

Connectors in which the contacts are provided with resilient-tensioning means are known according to the state of the art; this type of assembly is normally designed to avoid deformations or damage to the contacts which are normally numerous in these connectors. One of the main problems of this type of contact consists in ensuring conduction in the terminal inside which the resilient-tensioning means, usually consisting of a helical spring, are inserted. Despite the fact that the said spring is made of a material with good conducting properties, its cross-section varies depending on its compression and moreover its contact area with the parts involved in the connection is never certain.

In order to overcome this problem, it was thought to provide the pin which is tensioned by the spring with a coaxial stem which passes through the spring and which co-operates, at the end opposite to the pin, with a contact element in the form of a scored hyperboloid, able to maintain always contact with the external surface of the stem and therefore ensure conduction in a decidedly reliable manner, independently of the state of compression of the spring.

One drawback of this solution consists in the difficulty of alignment between the hyperboloid and the stem of the pin, since even a minimum misalignment during manufacture of the assembly may result in considerable problems both from the point of view of efficiency of the contact and from the point of view of its working life and mechanical reliability.

The object of the present invention is therefore to provide a contact provided with resilient-tensioning means in which on the one hand conduction is ensured with the maximum continuity and efficiency and on the other hand the assembly is not affected by problems connected with the use of a given type of constructional solution.

The invention therefore relates to a contact for electrical or electronic connections, comprising a contact pin provided with resilient-tensioning means which act in an axial direction on the said pin, being provided with a coaxial stem which extends at the end of said pin opposite to that intended for connection, said stem being inserted inside a contact means in the form of a scored hyperboloid; said pin, said resilient-tensioning means and said hyperboloid being enclosed inside a substantially cylindrical and substantially single-piece container body, locating means being envisaged for said resilient-tensioning means.

In one embodiment, said container body is provided, at the end in which said scored hyperboloid is arranged, with a closing element which is forced onto said hyperboloid; in this case, the locating means for the resilient-tensioning means are shoulders which are formed by means of milling or similar methods inside said container. Alternatively, said container body is single-piece, the hyperboloid is introduced inside the container and the locating means are obtained by means of constriction of the walls of said container following introduction of the hyperboloid.

Figure 2:
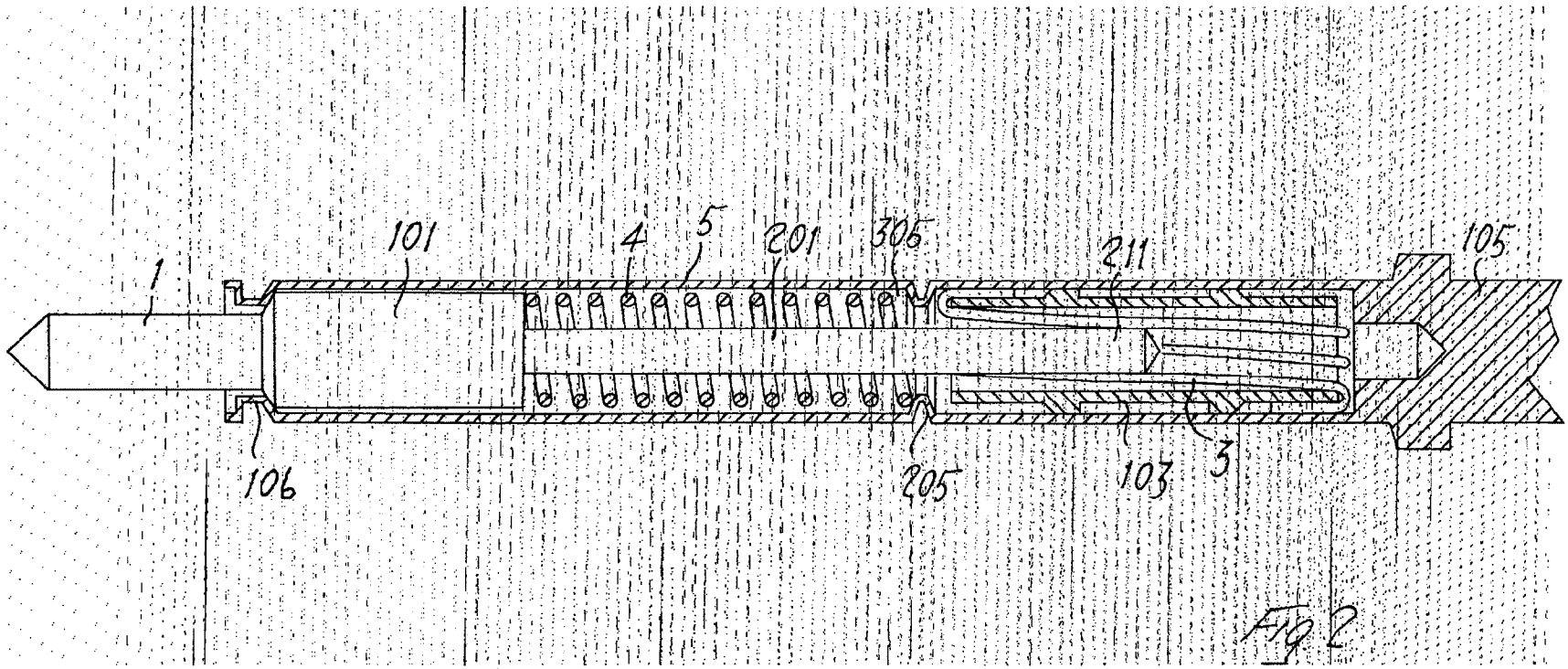

Further advantages and characteristic features of the device according to the present invention will become clear from the following detailed description of some embodiments thereof, provided by way of a non-limiting example, with reference to the accompanying plates of drawings in which:

FIG. 1 shows a longitudinally sectioned view of a first embodiment of the contact according to the present invention; and FIG. 2 shows a longitudinally sectioned view of a second embodiment of the contact according to the present invention.

FIG. 1 shows a first embodiment of the contact according to the present invention; 1 denotes the pin of said contact. This pin is provided with an end lug 101 which is inserted inside the tubular container body 2, the exit edge of which in the vicinity of the pin is folded inwards in the form of the flange 102, so as to fasten the pin to said body 2. From the end of the end lug 101 opposite the pin 1 there extends an axial stem 201 which passes through the body 2 substantially along its entire length, as well as the radial toroidal shoulder 202 projecting towards the inside of the said body 2; a helical spring 4 is arranged between the end lug 101 and the shoulder 202. The free end 211 of the stem 201 co-operates with the hyperboloid 3 which is inserted by means of its support 103 in the end of the body 2, so as to bear against the shoulder 202. The other end of the hyperboloid 3 and its support 103 are inserted, forced, inside the blind cavity 312 of the terminal 302 which therefore completes the constructional form of the contact.

FIG. 2 shows a second embodiment of the contact according to the present invention; parts which are the same are indicated by the same numbers. In this case, the container body is formed as a single hollow cylindrical element as one piece with the terminal 105; the hyperboloid 3 with its support 103 is inserted in the bottom of the cavity 305 of said body 5. The constriction 205 separates the hyperboloid 3 from the spring 4, while the same constriction allows the end 211 of the stem 201 connected to the end lug 101 of the pin 1 to pass through. The end lug, finally, is locked in position inside the body 5 owing to the constriction 106 formed at the end of the body directed towards the pin 1.

The operating principle of the contact according to the present invention and its constructional design will become clear from the explanation given below. As can be noted in both the embodiments described above, the pin 1 and its end lug 101 may be easily moved along their axial path allowed by the spring 4, without this resulting in a variation in the conduction efficiency of the contact; in fact, the end 211 of the stem 201 co-operates constantly with the hyperboloid 3, without there being problems due to the movement of the stem 201 itself. Moreover, the fact that the stem is contained within the body 2 or 5, which also houses, partly or completely, the hyperboloid 3, guarantees an axial movement which is guided with the maximum precision, avoiding risks of distortions due to misalignment and consequent non-uniform wear.

The manufacture and assembly of the contact shown in FIG. 1 consists in forming, inside the body 2, the shoulder 202 which is obtained by means of milling or similar procedures; then, on the one hand the spring 4 and on the other hand the hyperboloid 3 with its support 103 are introduced. At this point the pin 1 with its end lug 101 and the stem 201, which passes through the spring 4, the shoulder 202 and is introduced inside the hyperboloid, are inserted; the end opposite to that where the hyperboloid 3 is situated is then clamped so as to form the flange 102. Then, the cavity 312 of the terminal 302 is forced onto the portion of the hyperboloid 3 still projecting outside the body 2, thus forming in this way the complete contact.

In the embodiment according to FIG. 2, the body 5 is single-piece and at the blind end is provided with the terminal 105. The hyperboloid 3 with its support 103 is introduced firstly into the cavity 305 of the body 5; then the wall of the body 5 is deformed so as to create the constriction 205 which at the same time locks the hyperboloid 3 in its seat and ensures location of the spring 4 which is inserted inside the cavity 305. Then it is the turn of the assembly consisting of pin 1, end lug 101 and stem 201, with final tightening obtained by deforming again the wall of the body 5 towards the exit edge of the cavity 305, so as to create the constriction 106.

Both the constructional variants result in a product which achieves optimum functional results, both are decidedly simple and both ensure that the contact is able to function overcoming the problems previously described which are common to the state of the art.

The contact designed in this way represents a notable improvement in the context of contacts provided with resilient-tensioning means and is clearly applicable in all those sectors relating to electrical or electronic connections where a high degree of precision and reliability must be combined with mechanical strength and safety.

The invention claimed is:

1. A contact for electrical or electronic connections, comprising, a substantially cylindrical container body, a contact pin having a contact end which extends out of an end of the container body, a resilient means which acts in an axial direction on said pin to urge the pin in a direction out of the end of the container body, said pin being provided with a coaxial stem which extends from the pin in a direction away from the contact end of the pin, said stem being located inside a contact means in the form of a hyperboloid, the resilient means and the hyperboloid being enclosed in the container body, and a locating means located in the container body and separating the resilient means from the hyperboloid in an axial direction.

2. A contact according to claim 1, in which said container body is provided, at an end where said hyperboloid is arranged, with a closing element which is connected to a terminal of said contact and is forced onto said hyperboloid.

3. A contact according to claim 2, in which the locating means for the resilient means is a shoulder which is formed by means of machining the inside of the container body.

4. A contact according to claim 1, in which said container body is a single-piece, provided with a blind cylindrical cavity and has a terminal of said contact at the blind end of the cylindrical cavity.

5. A contact according to claim 4, in which the locating means comprises a constriction of a wall of the container body.

6. A contact according to claim 1, wherein the hyperboloid is scored.

7. A contact according to claim 1, wherein the hyperboloid is supported by the container body.

* * * * *